United States Patent [19]

Cina et al.

[11] 4,191,239

[45] Mar. 4, 1980

[54] BLOW PLATE STRUCTURE AND MOLD FORMED THEREBY

[75] Inventors: Ronald A. Cina; Albert D. Kluge, both of Lansing, Mich.

[73] Assignee: Roberts Corporation, Lansing, Mich.

[21] Appl. No.: 874,869

[22] Filed: Feb. 3, 1978

Related U.S. Application Data

[63] Continuation-in-part of Ser. No. 763,813, Jan. 31, 1977, Pat. No. 4,074,744.

[51] Int. Cl.[2] ..... B22C 15/24; B22C 9/02

[52] U.S. Cl. ..... 164/200; 164/349

[58] Field of Search ..... 164/37, 200, 202, 16, 164/201, 361, 235, 349

[56] References Cited

U.S. PATENT DOCUMENTS 3,137,902 6/1964 Peras ..... 164/200 X

FOREIGN PATENT DOCUMENTS 1098278 7/1955 France ..... 164/202

*Primary Examiner*—Robert D. Baldwin
*Assistant Examiner*—Gus T. Hampilos
*Attorney, Agent, or Firm*—Miller, Morriss and Pappas

[57] ABSTRACT

A mold apparatus and method for minimizing the amount of chemically bonded molding sand needed to form a block mold which consists of a flask mounted upon a pattern plate and a sand minimizer blow plate which is selectively movable into engagement with the upper edge surface of the flask mounted upon the pattern plate so as to form a mold cavity therewith into which the chemically bonded molding sand is blown so as to form the sand mold. The sand minimizer blow plate is provided with pocket forming finger extensions which extend downwardly into the mold cavity so as to form block sand minimizer pocket cavities in the completed sand mold.

3 Claims, 6 Drawing Figures

BLOW PLATE STRUCTURE AND MOLD FORMED THEREBY

This is a continuation-in-part application of the copending application Ser. No. 763,813 filed Jan. 31, 1977 and issued as U.S. Pat. No. 4,074,744 on Feb. 21, 1978.

SUMMARY OF THE INVENTION

This invention relates to a mold apparatus and method which utilizes a plurality of pocket forming finger extensions which extend downwardly into the mold forming apparatus so as to form sand minimizer pocket cavities in the completed sand mold. More specifically, this invention is adapted for use with automatic mold machines for producing molds using chemically bonded sands. As used herein, the word "mold" means the cope and/or drag mold half which is produced by this invention.

A sand minimizer blow plate is provided having finger extension pocket formers provided therein which is adapted for mounting within an automatic molding machine. The sand minimizer blow plate is moved into engagement with a flask mounted upon a pattern plate so as to form a mold cavity into which the chemically bonded molding sand is blown so as to form the sand mold.

As formed, the sand mold has sand minimizer pockets or cavities provided therein so that the amount of chemically bonded sand required to form the mold is substantially decreased. The use of less sand results in savings due to the fact that less catalyst and resin materials are required to form the sand molds.

None of the mold machines or mold making methods of the known prior art show or otherwise anticipate the use of sand minimizer pocket or cavity formers to form sand molds having pockets or cavities provided therein so as to minimize the amount of sand required to form the sand mold. Representative of the known prior art patents are Wood U.S. Pat. No. 2,349,219, Sutter U.S. Pat. No. 2,867,017, Ellms U.S. Pat. No. 3,089,205, Miller U.S. Pat. No. 3,205,542, Hunter U.S. Pat. No. 3,406,738, Hunter U.S. Pat. No. 3,520,348, Lund U.S. Pat. No. 3,528,481, Lund U.S. Pat. No. 3,556,195, Masi U.S. Pat. No. 3,695,338 and Ikuo U.S. Pat. No. 3,674,129.

It is thus seen that a need has existed for a mold making apparatus provided with sand minimizer pocket or cavity formers so as to make sand molds having pockets or cavities in the upper surfaces thereof so as to minimize or decrease the amount of chemically bonded sand needed to form the sand mold.

It is therefore an object of this invention to provide a mold making apparatus which utilizes a blow plate having a pocket or cavity forming extensions which extend into the mold making cavity so as to form sand molds having pockets or cavities in the upper surfaces thereof so as to minimize or decrease the amount of chemically bonded sand required to form the sand mold.

Other objects and advantages found in the construction of the invention will be apparent from a consideration of the following specification in connection with the appended claims and the accompanying drawings.

IN THE DRAWINGS

DESCRIPTION

Figure 5:
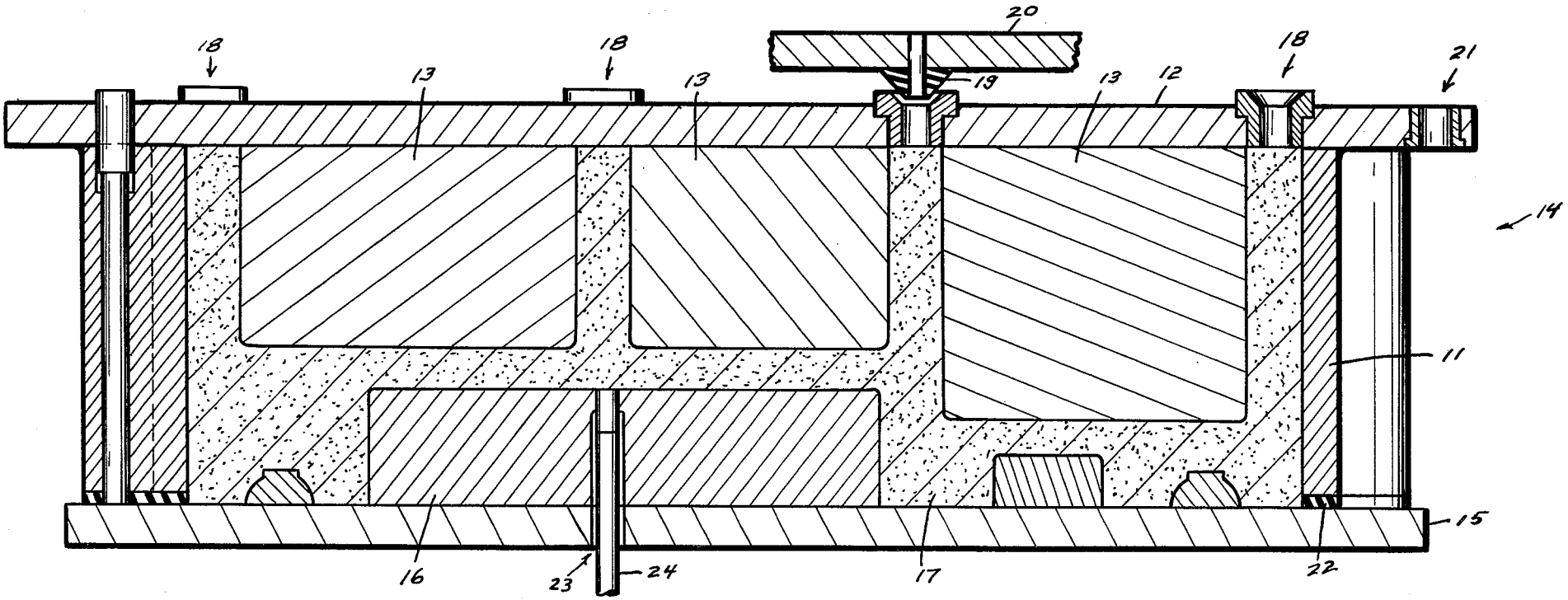
FIG. 5 is a cross sectional view of the mold making apparatus taken on line 5—5 of FIG. 3.
Figure 6:
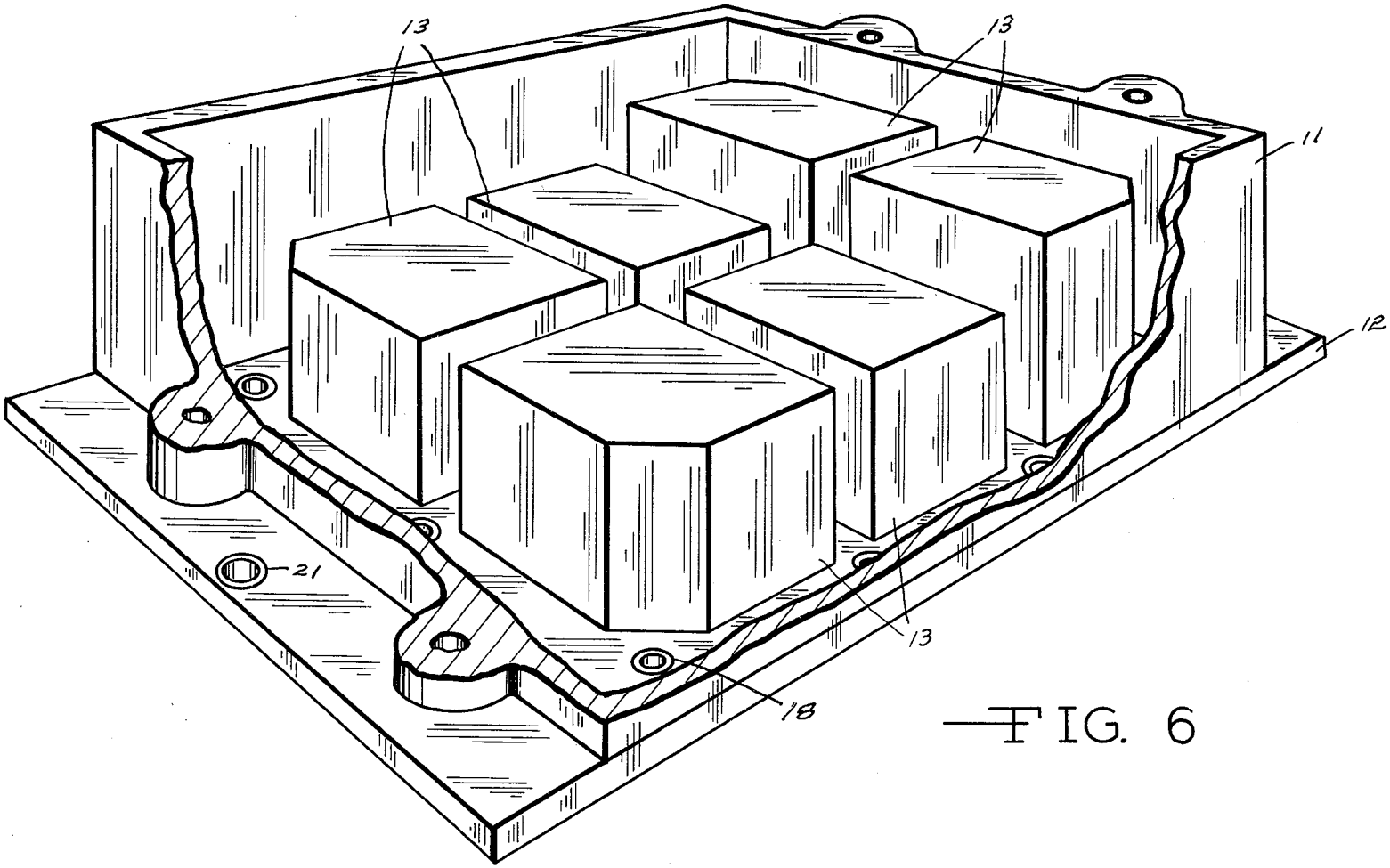
FIG. 6 is an inverted breakaway perspective view of the molding flask showing the sand minimizer blow plate provided with pocket forming extensions.

As shown in the inverted view FIG. 6, a flask 11 is provided having a sand minimizer blow plate 12 positioned across the top portion thereof. A plurality of downwardly extending spaced-apart pocket forming extensions 13 are provided on the blow plate 12 so as to extend into the mold forming cavity of the mold forming apparatus 14 as shown in FIG. 5.

Figure 3:
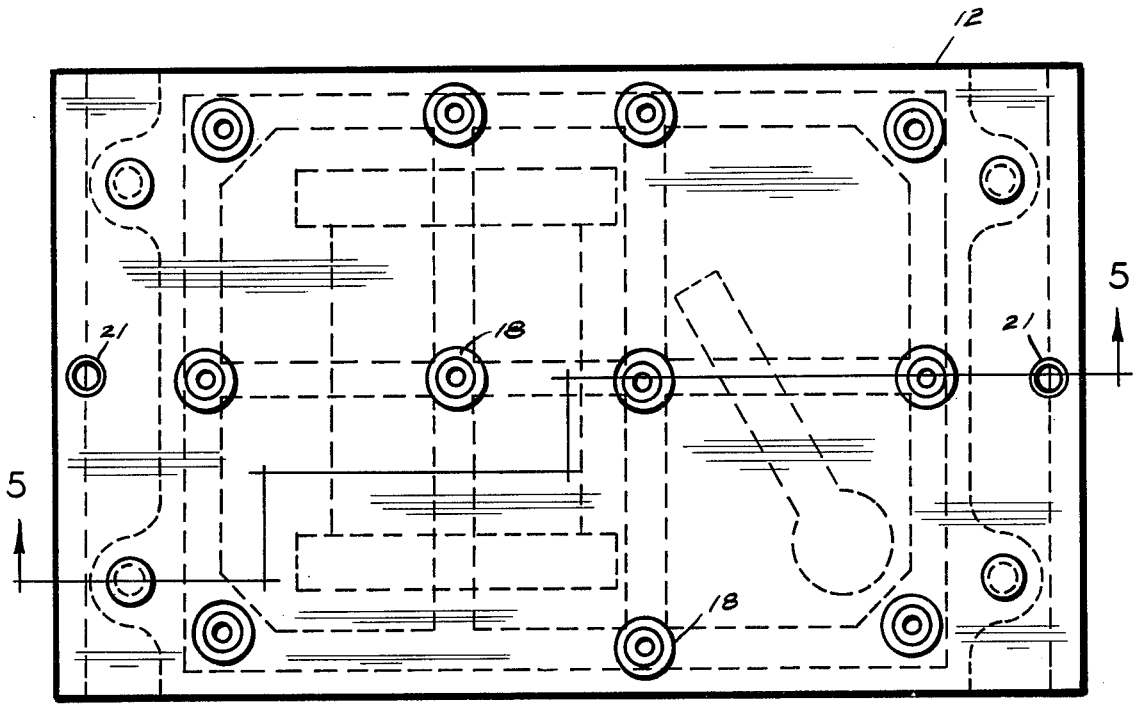
FIG. 3 is a top view of the mold making apparatus showing the upper surface of the sand minimizer blow plate with the blow hole openings therethrough.
Figure 4:
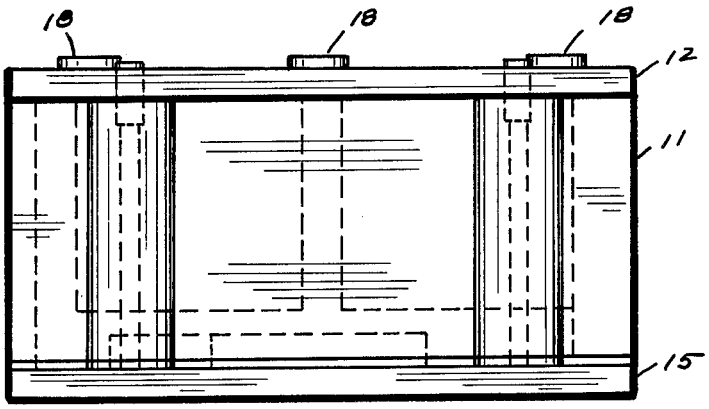
FIG. 4 is an end view of the sand minimizer blow plate, the flask and the pattern plate in their operative use engagement positions to form a mold cavity.

The embodiment of the invention shown in FIG. 5 has been simplified for purposes of illustration from the embodiment shown in FIG. 6. It is within the scope of the invention to vary the number of pocket forming extensions 13 as required by the configuration of the specific sand mold being formed. As further shown in FIGS. 3, 4 and 5 the flask 11 is shown in mating engagement with a pattern plate 15 upon which any desired pattern 16 is mounted within the size capability of the machine. Thus assembled, the pattern plate 15, flask 11, molding and blow plate 12 form a mold cavity into which the chemically bonded sand is blown in order to form the block sand mold 17. The blow plate 12 is provided with downwardly extending spaced-apart sand minimizer pocket forming finger extensions 13 which extend downwardly into the block sand mold forming cavity defined by the pattern plate 15, the flask 11 and the blow plate 12. The spaced-apart sand minimizer pocket forming finger extensions cooperate to define honeycomb grid support wall forming cavities therebetween which selectively extend to the lower planar surface of the blow plate 12 and the inner planar surfaces of the flask member 11. The grid wall forming cavities are in open communication with the block sand mold forming cavity formed by the pattern plate 15, the flask 11 and the blow plate 12. Blow hole openings 18 are provided through the sand minimizer blow plate 12 and are adapted to engage the pinch type blow tips 19 provided on the blow head 20 of the automatic mold machine, as shown in FIG. 5. Although the pinch type blow tips 19 are shown in their open configuration, they are normally closed so as to retain the sand in the sand magazine (not shown). The blow tips 19 open when air pressure is introduced to deliver the sand from the sand magazine through the blow tips 19 and blow hole openings 18 into the mold cavity to form sand mold 17. Locator bushing openings 21 are provided at the end portions of the sand minimizer blow plate 12 so as to receive the positioning pins (not shown) of the automatic molding machine. A resilient compression spacer strip 22 is provided between the flask 11 and the pattern plate 15. However, the spacer strip 22 is not considered to be a necessary element in the instant invention. Thus, in one embodiment of the invention, the use of the spacer strip 22 is omitted so that the flask 11 rests directly upon the pattern plate 15 in order to form the mold cavity. The pattern plate 15 is also provided with stripper pin holes 23 to accommodate stripper pins 24 which are used to remove the completed mole 17 from the molding apparatus. However, the stripper pins 24 are not considered to be a part of the instant invention. The present invention comprises the use of pocket forming extensions which extend into the mold cavity so as to form a sand mold having sand minimizer pockets or cavities therein, thus decreasing the amount of sand required to form the sand mold.

The overall operation of the automatic mold machine is described in the co-pending application Ser. No. 763,813 filed on Jan. 31, 1977 (issued as U.S. Pat. No. 4,074,744 on Feb. 21, 1978) and will not be repeated at this time, but is incorporated herein by reference.

Figure 1:
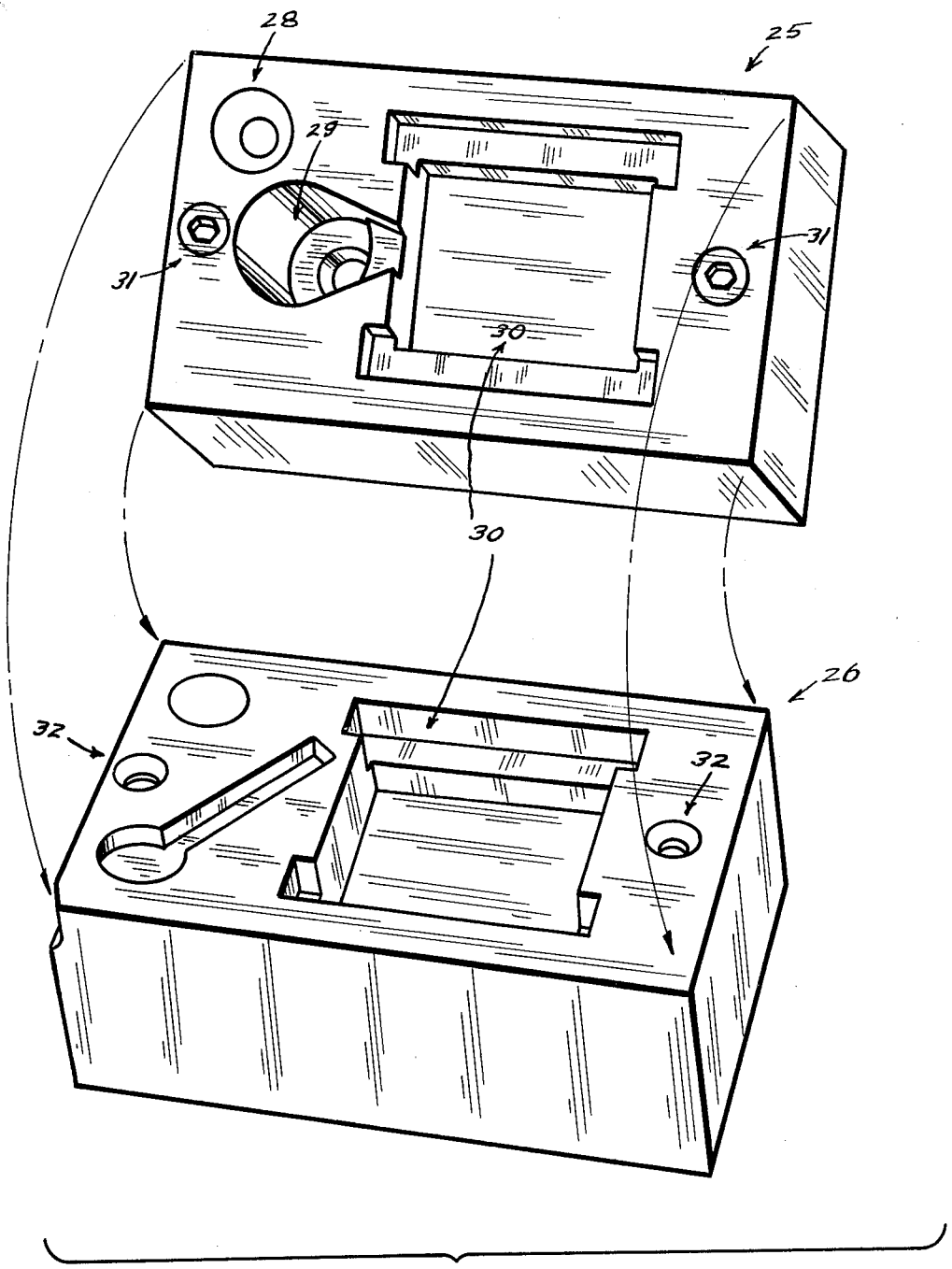
FIG. 1 is a perspective view of sand mold half components showing the inside surfaces with casting cavities formed therein.
Figure 2:
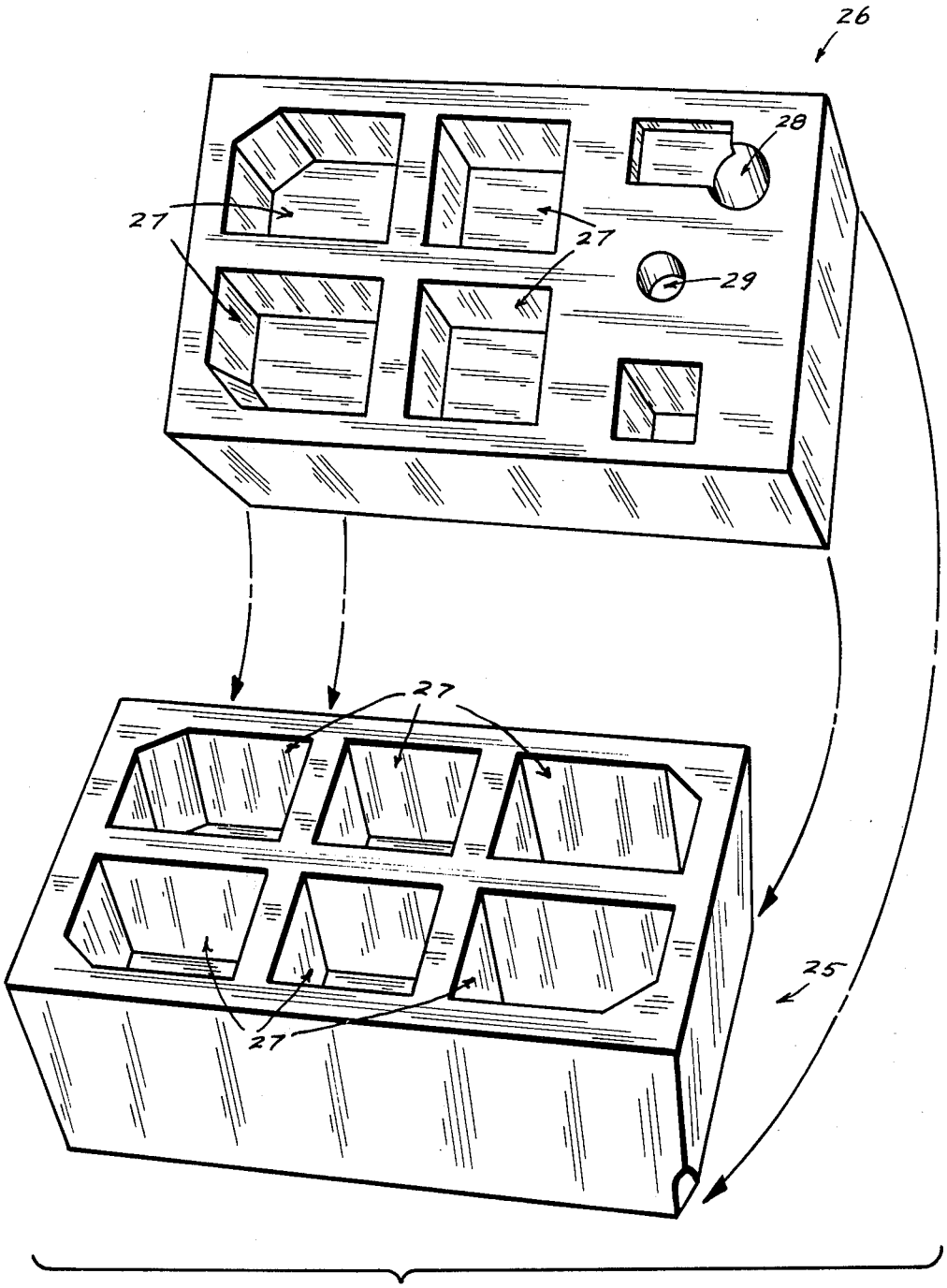
FIG. 2 is a perspective view of sand mold half components showing the outside surfaces with sand minimizer pockets formed therein.

Thus, as shown in FIGS. 1 and 2, sand molds (mold halves) 25 and 26 are produced with sand minimizer pockets 27 formed therein so as to minimize or decrease the amount of sand utilized in forming the mold half cope and drag portions of an overall sand mold. As shown in FIG. 2, the upper surfaces of each sand mold (mold half) 25 and 26, respectively, are provided with sand minimizer pockets 27 therein. A representative sprue hole 28 and a representative riser opening 29 are also shown.

As shown in FIG. 1, the lower surface of each sand mold (mold half) 25 and 26 is shown with a representative casting cavity 30 provided therein. Locator projections 31 and corresponding locator holes 32 are provided on each respective sand mold (mold half) 25 and 26. In use, the sand mold (cope half) 25 is placed upon the sand mold (drag half) 26.

Although the preferred embodiment of the invention has been shown and described for use in connection with an automatic mold machine using chemically bonded sands, it is to be considered with the scope of the invention that the concept of using sand minimizer pocket forming extensions can be applied to all types of automatic or manual molding equipment whereby the pocket forming extensions extend into the mold cavity so as to decrease the amount of sand required to form the sand mold.

In summary, a mold apparatus for forming sand molds is provided for use in association with an automatic mold machine. The mold apparatus comprises a pattern plate which is adapted to support selected casting patterns on the upper surface thereof. A molding flask member is provided on the upper surface of the pattern plate so as to extend upwardly therefrom. In one embodiment of the invention, a resilient compression strip member is provided around the lower edge surface of the flask member so as to be positioned intermediate the molding flask member and the pattern plate upon which the flask member is mounted. However, as stated previously, the compression strip member is not considered to be essential in the present invention. A blow plate is selectively positioned across the top of the molding flask so as to define a sand mold forming cavity in cooperation with the pattern plate and the flask member. As thus described and as shown in the drawings, the flask member is positioned intermediate the pattern plate and the blow plate so as to form the sand mold forming cavity. As shown in the drawings, the blow plate is provided with a plurality of pocket forming finger extensions which extend downwardly into the mold cavity. Thus positioned, the pocket forming finger extensions act to decrease the volume of the mold cavity so that the amount of chemically bonded sand necessary to fill the mold cavity is correspondingly decreased. It should be noted that although a plurality of pocket forming finger extensions are shown in the embodiment of the invention shown in the drawings, it is to be considered within the scope of the invention that the number of pocket forming finger extensions and the sizes thereof can be selectively varied in accordance with the specific sand mold being formed. Thus, even a single pocket forming finger extension can be utilized if that would be sufficient to form the desired sand mold. The blow plate is also provided with at least one or more blow hole openings therethrough which chemically bonded sand is blown to fill the mold cavity.

While the mold apparatus shown and described herein is intended for use in connection with an automatic mold machine shown and described in the co-pending patent applications entitled Apparatus for Producing Molds Using Chemically Bonded Sands, Ser. No. 763,813 and Method for Producing Molds Using Chemically Bonded Sands, Ser. No. 842,724, it is considered to be within the scope of this invention to manually produce sand molds which have sand minimizer pocket cavities formed in the surface opposite the surface in which the casting cavity is formed. Thus, a sand mold member is formed having a lower surface in which a selected casting cavity is defined or formed and an upper surface in which sand minimizer pocket cavities therein so as to minimize the amount of sand required to form the sand mold member. It should be noted that the sand minimizer pocket cavities are not in communication with the casting cavity and are not involved in the actual casting operation.

Although the mold half shown and described herein has been referred to as a sand mold formed by the use of chemically bonded sand, it is to be considered as being within the scope of the invention to utilize other materials such as aluminum, glass beads and the like to form the mold.

As described herein and as shown in the drawings, the block sand mold member thus formed has side, upper and lower planar surfaces which makes it amenable to automated handling by automatic mold handling equipment without the need for ancillary mold support structures. The lower planar surface defines a selected casting cavity therein. The upper planar surface defines one or more spaced-apart sand minimizer pocket cavities therein so as to minimize the amount of sand required to form the block sand mold member. The spaced-apart sand minimizer pocket cavities define honeycomb grid support walls therebetween which selectively extend to the upper planar surface of the block sand mold member.

It is thus seen that a highly utilitarian molding apparatus and method for forming a sand mold half is provided which minimizes or decreases the amount of chemically bonded sand needed to form a sand mold with resultant savings in the cost of the catalysts and resins which are used in connection with the chemically bonded sand.

Various other modifications of the invention may be made without departing from the principle thereof. Each of the modifications is to be considered as included in the hereinafter appended claims, unless these claims by their language expressly provide otherwise.

We claim:

1. In a mold apparatus for forming block sand molds in connection with an automatic mold machine comprising:

a pattern plate adapted for supporting selected patterns on the upper surface thereof;

a four sided molding flask member mounted on the upper surface of said pattern plate, said molding flask having vertically extending side walls which intersect at right angles to form a four sided flask member; and a blow plate selectively positioned across the top of said flask so as to define a block sand mold forming cavity in cooperation with said pattern plate and said molding flask member, said blow plate provided with one or more spaced-apart sand minimizer pocket forming finger extensions having vertical planar side walls which extend downwardly from the blow plate into said molding flask member, said spaced-apart sand minimizer pocket forming finger extensions being spaced from the side walls of said molding flask and cooperating with said flask to define honeycomb grid support wall forming cavities therebetween which cavities extend to the said blow plate and said flask member, said honeycomb grid wall forming cavities being in open communication with said block sand mold forming cavity, said blow plate provided with one or more blow hole openings therethrough through which sand is blown to fill said sand mold forming cavity and said honeycomb grid support wall forming cavities.

2. In the mold apparatus of claim 1 wherein a resilient compression strip member is provided intermediate said flask member and said pattern plate, said compression strip member cooperating with said pattern plate, said flask member and said blow plate to define a sand mold forming cavity.

3. A block sand mold member of a block sand mold, said block sand mold member being shaped to define pairs of spaced apart opposed parallel planar side walls, an upper planar surface having a selected mold cavity formed therein and a lower planar surface having spaced apart sand minimizer pocket cavities formed therein; said upper and lower planar surfaces being spaced apart and parallel to each other with said pairs of spaced apart opposed parallel planar side walls being interposed therebetween and normal thereto thus defining said block sand mold member; said lower planar surface having said spaced apart sand minimizer pocket cavities formed therein so as to minimize the amount of sand required to form the block sand mold member; the spaced-apart sand minimizer pocket cavities being defined by support walls having planar side surfaces and a planar top surface which planar top surface forms a portion of said upper planar surface; said support walls being integral with said block sand mold member extending at least a portion of the distance between said pairs of spaced apart opposed parallel planar side walls and a predetermined distance from said lower planar surface into the block mold member; said support walls cooperating with said block sand mold member to define a honeycomb grid wall arrangement thereby defining said spaced apart sand minimizer cavities.

* * * * *